US006719650B1

(12) United States Patent
Thurlow

(10) Patent No.: US 6,719,650 B1
(45) Date of Patent: Apr. 13, 2004

(54) PLACE-KICKING PRACTICE HOLDER

(76) Inventor: Sean Thurlow, 52 Thurlow Rd., Twisp, WA (US) 98856

( * ) Notice: Subject to any disclaimer, the term of this patent is extended or adjusted under 35 U.S.C. 154(b) by 26 days.

(21) Appl. No.: 10/171,405

(22) Filed: Jun. 13, 2002

(51) Int. Cl.[7] ..... A63B 69/00; A63B 71/00
(52) U.S. Cl. ..... 473/420; 473/422
(58) Field of Search ..... 473/419, 420, 473/418, 422, FOR 126; D21/716

(56) References Cited

U.S. PATENT DOCUMENTS 3,472,511 A * 10/1969 Shirley et al. ..... 473/419
4,477,077 A * 10/1984 Ferrebee ..... 473/419
4,946,165 A * 8/1990 Rambacher ..... 473/419
D338,250 S * 8/1993 Tvedt ..... D21/716
5,464,209 A * 11/1995 Sang ..... 473/419
5,490,668 A * 2/1996 Ritch ..... 473/419
5,505,445 A * 4/1996 Treadwell et al. ..... 473/419
5,553,855 A * 9/1996 Balestrieri ..... 473/419

* cited by examiner

*Primary Examiner*—Gregory Vidovich
*Assistant Examiner*—Mitra Aryanpour
(74) *Attorney, Agent, or Firm*—Sean D. Thurlow

(57) ABSTRACT

An apparatus for holding an American football includes a CPVC horizontal arm, removably attached to a vertical post composite, that is removably attached to a securing means. The horizontal arm has an elbow tip removably attached at one end that holds the tip of the football. On the other end of the horizontal arm is a swivel elbow, removably attached to the vertical post composite. The the vertical post is comprised of two parallel materials, half inch PVC on the outside, stronger and smaller diameter half inch CPVC on the inside. There is a bolt dowel near the bottom of the vertical post composite that holds the parallel materials together. The structural composite of the vertical post is shorter than the length of a football. The structural composite of the vertical post insures the horizontal arm will not slip past the exact position the of vertical post is built for.

1 Claim, 1 Drawing Sheet

PLACE-KICKING PRACTICE HOLDER

BACKGROUND-FIELD OF INVENTION

Figure 1:
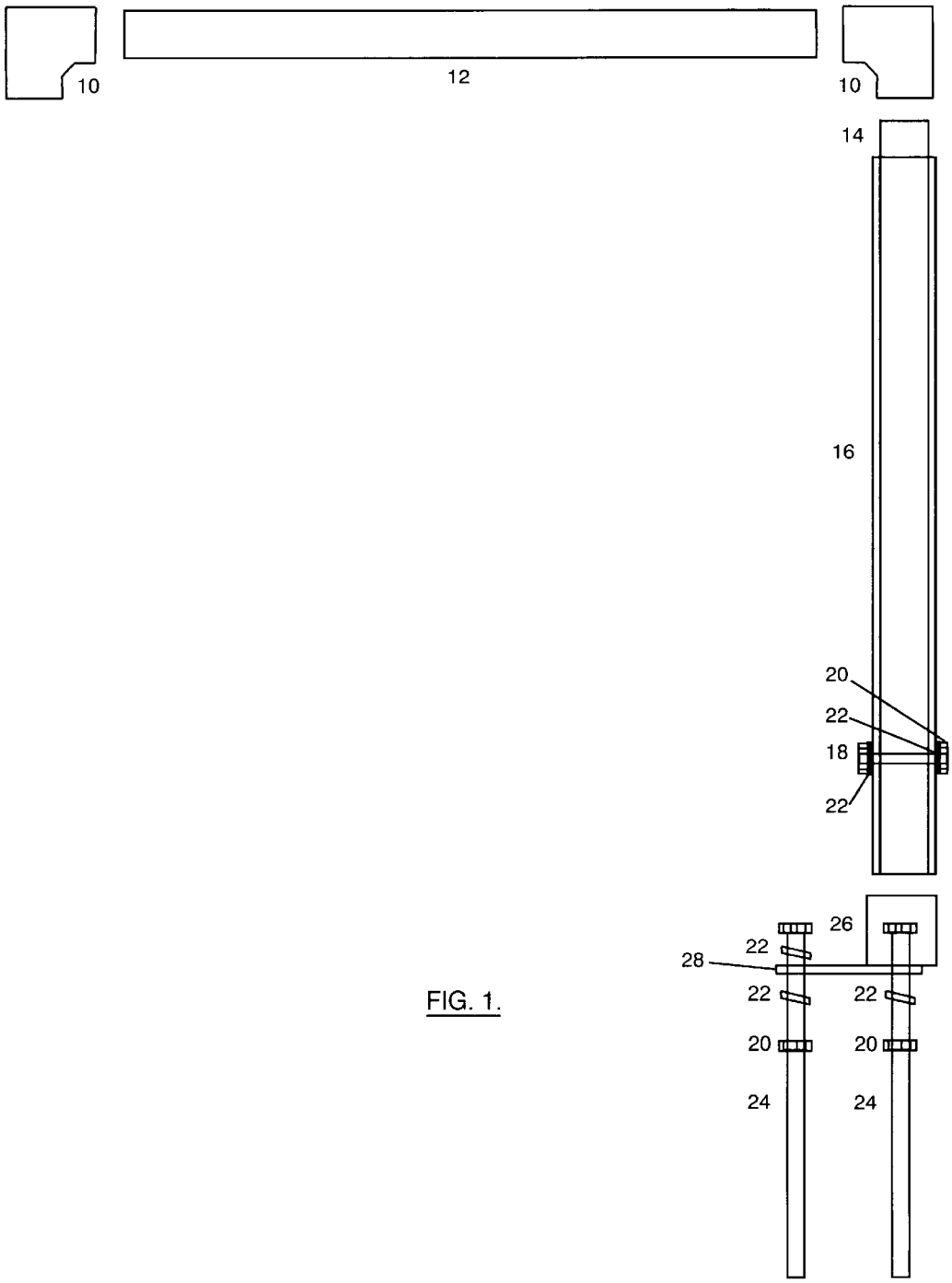

This invention relates to American football kick-off tees and PAT's. This specifically can be used with or without a PAT for field goal kicking and extra points.

BACKGROUND-DISCUSSION OF PRIOR ART

Previous to this invention, a place-kicker either had to rely on another person to hold a football in position or would need to use a kick-off tee for field goals and extra points.

Using a kick-off tee for practicing field goals and extra points is no longer necessary. The placekicking practice holder fills this void. This tool can hold the football in position on the ground for professional football or on a PAT for college and high school levels.

A PAT is a square shape block made from rubber that a football is place upon for kicking field goals and extra points. Professionals can only use another person for holding a football in the right position on the ground. A kick-off tee would hold the ball above the ground, hence not in the right position.

For college and high school level football, a PAT can be used with-the place kicking practice holder to perfectly simulate field goals and extra points, by holding the football in the right position.

Without the place-kicking practice holder, place-kickers at the college and high school levels had no way to practice with a PAT, unless another person holds the ball on top of it. A person trying to simulate place-kicking without any help, could not use a PAT with a Kick-off tee. A person by themselves, could not even use the tool necessary without the placekicking practice holder. It also holds the ball on any football kicking tee during windy conditions.

Objects and Advantages

The objects and advantages of the place-kicking practice holder is are:

(a) allows a professional place-kicker to practice field goals and extra points with the ball being held on the ground in the right position.

(b) allows college or high school level place-kickers to practice field goals and extra points with a PAT, thus having the ball in the right position.

(c) allows all levels of place-kickers to practice field goals and extra points without a kick-off tee.

(d) allows all levels of place kickers to practice field goals and extra points without the help of another person.

(e) is made of strong, durable pvc, cpvc, bolts, nuts, lock washers and is very durable, (f) cap be adjusted to the use of a PAT or different ground surfaces just by pushing down or pulling up on the one-quarter inch, five inch long ground spikes.

(g) the tilt of the ball can be adjusted by moving the horizontal arm and elbow tip.

(h) sections of the place kicking practice holder easily slide apart so that it can be packed in a sport bag or suit case.

(i) for hard ground surfaces, the one-quarter inch spike bolts can be replaced with smaller three-sixteenth inch spike bolts.

(j) the one-quarter inch by five inch spike bolts work well on all ground surfaces it was tested on.

(k) For astro turf, the placekicking practice holder can be screwed to the surface.

(l) Will hold a football on any football tee during windy conditions.

DRAWING FIGURES

In the FIG. 1 drawing, the same figures have the same number and begin at 10.

REFERENCE NUMERALS IN DRAWING

| | | | |
|---|---|---|---|
| 10 | half inch cpvc elbow | 20 | one quarter inch hex nut |
| 12 | half inch cpvc pipe(horizontal arm) | 22 | one quarter inch lock washer |
| 14 | half inch cpvc pipe | 24 | one quarter inch hex bolt, five inches long |
| 16 | half inch pvc pipe(vertical post) | 26 | half inch pvc plastic cap |
| 18 | one quarter inch hex bolt, one and a half inch long | 28 | mending brace, two inches long |

SUMMARY

This is a place-kicking practice holder, a tool for the sport of football, comprising: A pvc and cpvc structures with two elbows, and two bolts, held together with a mending brace that push into the ground and hold the practice holder into position.

a. This tool will hold a football on a PAT, used in college level football and under.

b. This tool will hold a football on the ground, the method used at the professional level in football.

c. The horizontal arm and two elbows swivel completely to hold the ball and control the desired tilt of the ball.

d. For use with a PAT, push the bolts into the ground as far as needed depending on the ground surface.

e. For use without a PAT, push the bolts all the way into the ground or as far as needed depending on the ground surface.

f. The bolts can be replaced with three-sixteenth inch bolts for harder ground surfaces.

g. For astro turf the placekicking practice holder can be screwed to the ground.

h. The placekicking practice holder will hold the ball on any tee during windy conditions.

DESCRIPTION

A typical embodiment of the present invention is illustrated in FIG. 1. A half-inch cpvc elbow 10 (FIG. 1) attaches easily to the half-inch cpvc horizontal arm 12. This elbow swivels completely, holds the tip of the football and the tilt of the ball. The half-inch cpvc elbow 10 attaches the horizontal arm 12 to the vertical post. This elbow swivels completely also, helping to hold the ball and helping to control the tilt of the ball. This elbow attaches to the vertical post. The vertical post is half-inch cpvc 14 inside half-inch pvc 16. The vertical post consisting of half-inch cpvc and half-inch pvc is held tightly together with a one-quarter inch hex bolt 18 that is one inch long. The hex bolt 18 is tightened with a one-quarter inch hex nut 20.

The vertical post attaches to a half-inch pvc plastic cap 26. The plastic cap 26 has a one quarter inch hex bolt 24 that is five inches long. This hex bolt holds the plastic Cap 26 to a mending brace 28 and is held tightly together with one quarter inch lock washer 22 and a one quarter inch hex nut 20. The mending brace accommodates another one quarter inch hex bolt 24 that is five inches long. Between the hex bolt head and the mending brace 28 there is a one-quarter inch lock washer. This lock washer 22 allows for the two hex bolts 24 to be even in length. A one-quarter inch lock washer 22 and one quarter inch hex nut 20 hold the one quarter inch hex bolt 24 to the mending brace 28.

From the description above, a number of advantages of my placekicking practice holder become evident:

(a) The two elbows 10 and horizontal arm 12 hold the football in place without putting any pressure on the ball itself, thereby not affecting the kick.

(b) The two elbows 10 and horizontal arm 12 swivel completely allowing for the tilt of the football to be altered to the desired angle.

(c) The two hex bolts 24 attached to the mending brace 28 are necessary to hold the practice holder to the desired position, keeping thy practice holder from turning when the horizontal arm and two elbows are adjusted.

(d) The plastic cap 26 swivels completely allowing for flexibility, the ability to avoid obstacles in the ground or on the ground surface like rocks when positioning the practice holder.

(e) With the two hex bolts and mending brace, it is possible for this practice holder to be attached to any surface, such as astro turf.

(f) The bolts 24 allow the practice holder to be used with or without the use of a PAT.

(g) Since the practice holder is made of pvc, cpvc and bolts it is very durable, weather resistant and is lightweight, weighing less than half a pound.

(h) The placekicking practice holder slides easily apart into three separate pieces allowing it to be packed in a suitcase or sporting bag.

OPERATION

The manner of using the placekicking practice holder is most identical to using the help of a person to hold a football for kicking field goals and extra points. The only similar tool other than the conventional person at the holder position, is a kick-off tee.

The function of the placekicking practice holder is more exact than a kick-off tee and allows the use of a PAT or can be used without a PAT. A kick-off tee can not hold a football on the surface of the ground and can not be used with a PAT.

One first determines the desired place the practice holder should be situated on the field or practice area. Holding the elbow 10 attaching the horizontal cpvc 12 FIG. 1, push down setting the bolts into the ground. If necessary, one can swivel the pvc plastic cap 26 to avoid rocks on or below the surface of the ground.

Push down until the right depth is reached. To practice without a PAT, push down until the mending brace is touching the ground surface. To practice without a PAT, push down until the height of the PAT is considered. Since the ground surface will vary, one will need to make final adjustments on the proper depth of the bolts after setting the football in position. Two additional variations include sliding the mending brace down allowing for the exact height with the mending brace next to the ground. OR adding washers and additional nuts to hold the bolts at the exact height.

Place the football in position so that the elbow tip 10 rests over the tip of the football. Swivel the horizontal arm 12 while holding on to the football to make sure there is no down pressure on the football, so that the ball is simply held in place. In making final adjustments, the tilt of the ball can be changed by moving the horizontal arm 12 and the elbow tip 10.

If one is a left foot kicker the placekicking holder should be positioned to the left, if one is a right foot kicker the placekicking holder should be positioned to the right.

When the position of the placekicking holder needs to be done or one is done practicing, pull the placekicking practice holder up out of the ground surface by pulling from the vertical post 16.

CONCLUSION, RAMIFICATIONS AND SCOPE

Accordingly, the reader will see that the placekicking practice holder is the only tool that can be used with or without a PAT in the sport of football. The placekicking practice holder simulates a real person at the holder position. It will also hold the ball on any football tee during windy conditions.

Although the description above contains specifications, these should not be construed as limiting the scope of the invention but as merely providing illustrations of some of the presently preferred embodiments of this invention. For example, smaller diameter bolts can replace the one-quarter inch bolts 24 to penetrate harder ground surfaces. Screws can replace the bolts 24 for use on other surfaces like astro turf.

Thus the scope of the invention should be determined by the appended claims and their legal equivalents, rather than by the examples given.

I claim:

1. A place-kicking practice holder used for kicking field goals and extra point attempts, the place-kicking practice holder comprising:

a horizontal arm;

an elbow tip removably attached to an end of said horizontal arm; said horizontal arm and said elbow tip for holding a football in place, and controlling the desired tilt of said football;

a swivel elbow removably attached to the other end of said horizontal arm;

a vertical post having an outside pipe and a reduced diameter inside pipe securely held in place using an attachment member; said inside pipe extending upwardly through said outside pipe;

said swivel elbow allows for the rotational movement of said horizontal arm with respect to said vertical post; allowing for said arm to rotate 360 degrees; whereby the tilt of said football can be adjusted by moving said arm with respect to said elbow tip;

said outside pipe providing a safety stop when said horizontal arm and said swivel elbow are attached to said vertical post, said outer pipe safety stop for holding a football on a ground surface or on a ball holder;

a swivel cap for releasably attaching said vertical post to a mending brace; said mending brace comprising attachment means for attaching said practice holder to a desired position on a ground surface;

adjustment means for adjusting said place-kicking practice device relative to a ground surface and allowing for the leveling of said vertical post, and wherein said vertical post is slidably received on said means for adjusting;

wherein said horizontal arm, said elbow tip, said swivel elbow, said vertical post and said securing means are removably attached for storage; the place-kicking practice holder allowing for a football to be held on a ground surface in a desired position;

wherein said place-kicking practice holder permits all levels of place-kickers to practice field goals and extra point attempts without the aid of another person; and wherein right- or left-footed kickers can use the place-kicking practice holder with or without the aid of a ball holder.

* * * * *